US008297695B1

(12) United States Patent
Aiken et al.

(10) Patent No.: US 8,297,695 B1
(45) **Date of Patent: *Oct. 30, 2012**

(54) PORTABLE COOLING DEVICE

(75) Inventors: Tonia Dandry Aiken, New Orleans, LA (US); Charles W. Lanusse, Opelousas, LA (US); Tina Dandry Mayes, Marrero, LA (US); Shirley Jumonville Dandry, Marrero, LA (US); Alexes Elizabeth Aiken, New Orleans, LA (US); Brett Johnanthony Aiken, New Orleans, LA (US)

(73) Assignee: Breezzangel, LLC, New Orleans, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/356,331

(22) Filed: Jan. 23, 2012

Related U.S. Application Data

(63) Continuation of application No. 12/486,331, filed on Jun. 17, 2009, now Pat. No. 8,123,290.

(51) Int. Cl.
*A47C 7/74* (2006.01)
*A47C 31/11* (2006.01)
*A47C 4/28* (2006.01)

(52) U.S. Cl. ..... 297/180.1; 297/180.11; 297/180.13; 297/180.14; 297/180.15; 297/45; 297/219.1; 297/229

(58) Field of Classification Search ..... 297/45, 297/180.1, 180.11, 180.15, 180.13, 180.14, 297/219.1, 229; 5/413 R
See application file for complete search history.

(56) References Cited

U.S. PATENT DOCUMENTS

| | | | |
|---|---|---|---|
| 362,555 | A | 5/1887 | Thomas et al. |
| 3,295,886 | A | 1/1967 | Goldmerstein |
| 3,625,434 | A | 12/1971 | Kitover |
| 4,141,585 | A | 2/1979 | Blackman |
| 4,277,224 | A | 7/1981 | Lundgren |
| 4,548,357 | A | 10/1985 | Schmidt |
| 4,687,414 | A | 8/1987 | Wardy |
| 4,765,542 | A | 8/1988 | Carlson |
| 4,799,858 | A | 1/1989 | Shin-Chin |
| 4,825,488 | A | 5/1989 | Bedford |
| 4,846,525 | A | 7/1989 | Manning |
| 4,854,502 | A | 8/1989 | Cox |
| 4,861,301 | A | 8/1989 | Pomeroy et al. |
| 4,923,248 | A | 5/1990 | Feher |
| 4,961,535 | A | 10/1990 | Skibik |
| 5,000,384 | A | 3/1991 | Arnold |
| 5,027,455 | A | 7/1991 | Commisso et al. |
| 5,062,424 | A | 11/1991 | Hooker |
| D327,945 | S | 7/1992 | Chiang |
| 5,172,711 | A | 12/1992 | Mueller et al. |
| 5,233,705 | A | 8/1993 | Coleman et al. |

(Continued)

OTHER PUBLICATIONS

O2 Cool Misting Fans [online] [Retrieved from the internet Dec. 4, 2008] URL—http://www.o2-cool.com/misting_overview.php.

(Continued)

*Primary Examiner* — Rodney B White
(74) *Attorney, Agent, or Firm* — Jones, Walker, Waechter, Poitevent, Carrere & Denegre, L.L.P.

(57) ABSTRACT

A cooling system which having a body section which includes a flexible material; at least two mist dispensing fans connected to the body section; and control circuitry having at least a first switch controlling fan speed and a second switch controlling mist dispensing.

19 Claims, 17 Drawing Sheets

U.S. PATENT DOCUMENTS

| | | | |
|---|---|---|---|
| 5,304,035 | A | 4/1994 | Carter |
| 5,322,342 | A | 6/1994 | Gange |
| 5,397,268 | A | 3/1995 | Chang et al. |
| 3,228,317 | A | 1/1996 | Westman |
| 5,551,110 | A | 9/1996 | Armstrong et al. |
| 5,613,731 | A | 3/1997 | Aspinall |
| 5,722,596 | A | 3/1998 | Dome |
| 5,725,356 | A | 3/1998 | Carter |
| D396,104 | S | 7/1998 | Radtke |
| 5,823,617 | A | 10/1998 | Schafer |
| 5,837,167 | A | 11/1998 | Lederer |
| 5,843,344 | A | 12/1998 | Junkel et al. |
| 5,851,106 | A | 12/1998 | Steiner et al. |
| 5,873,624 | A | 2/1999 | Simpson |
| 5,965,067 | A | 10/1999 | Junkel et al. |
| 5,984,744 | A | 11/1999 | Lutz |
| 6,027,137 | A | 2/2000 | Rura |
| 6,109,874 | A | 8/2000 | Steiner et al. |
| 6,132,455 | A | 10/2000 | Shang |
| 6,135,714 | A | 10/2000 | Hsu |
| 6,155,782 | A | 12/2000 | Hsu |
| 6,158,669 | A | 12/2000 | Louis |
| 6,179,564 | B1 | 1/2001 | Park |
| D441,444 | S | 5/2001 | Shapiro |
| 6,237,896 | B1 | 5/2001 | Hicks et al. |
| 6,389,835 | B1 | 5/2002 | Uranga |
| 6,409,206 | B1 | 6/2002 | Willrich |
| 6,439,521 | B1 | 8/2002 | Wilson et al. |
| 6,454,539 | B1 | 9/2002 | Santos |
| 6,471,289 | B2 | 10/2002 | Aguilar |
| 6,592,049 | B1 | 7/2003 | Wolput |
| D486,310 | S | 2/2004 | Goldy |
| 6,698,827 | B2 | 3/2004 | Le Gette et al. |
| 6,705,334 | B2 | 3/2004 | Altobelli |
| 6,715,503 | B2 | 4/2004 | Brooks, III |
| 6,786,273 | B2 | 9/2004 | Ichigaya |
| 6,789,557 | B1 | 9/2004 | Wahl, Jr. |
| 6,802,265 | B1 | 10/2004 | Dodson et al. |
| 6,842,919 | B2 | 1/2005 | Wilson et al. |
| 6,843,527 | B2 | 1/2005 | Nelson et al. |
| 6,845,780 | B2 | 1/2005 | Bishirijian |
| 6,866,337 | B1 | 3/2005 | Lash |
| D504,221 | S | 4/2005 | Protano |
| 6,886,270 | B2 | 5/2005 | Gilmer |
| 6,886,759 | B1 | 5/2005 | Okronic et al. |
| 6,942,005 | B2 | 9/2005 | Le Gette et al. |
| 6,966,464 | B2 | 11/2005 | Betkowski |
| 7,000,984 | B1 | 2/2006 | Ward |
| 7,007,703 | B2 | 3/2006 | Brooks, III |
| 7,013,612 | B2 | 3/2006 | Haddock |
| 7,047,992 | B1 | 5/2006 | Fluellen |
| 7,048,333 | B2 | 5/2006 | Martinez |
| 7,059,671 | B1 | 6/2006 | Coggins |
| 7,066,476 | B2 | 6/2006 | Elden |
| 7,066,534 | B2 | 6/2006 | Choi |
| 7,070,231 | B1 | 7/2006 | Wong |
| 7,077,465 | B1 | 7/2006 | Calderon |
| 7,082,883 | B1 | 8/2006 | Arias |
| 7,100,338 | B2 | 9/2006 | Haddock |
| 7,104,468 | B2 | 9/2006 | Stengel |
| 7,150,162 | B1 | 12/2006 | Brunner |
| 7,175,224 | B2 | 2/2007 | Held |
| D542,402 | S | 5/2007 | Abell |
| 7,225,483 | B1 | 6/2007 | Remblad |
| 7,226,126 | B1 | 6/2007 | Spanovich |
| 7,229,060 | B2 | 6/2007 | Collins |
| 7,234,753 | B2 | 6/2007 | Held et al. |
| 7,240,975 | B2 | 7/2007 | DeMars |
| 7,243,990 | B1 | 7/2007 | Wahl |
| 7,252,329 | B1 | 8/2007 | O'Meally |
| 7,273,261 | B2 | 9/2007 | DeMars |
| 7,284,393 | B1 | 10/2007 | Macmillan |
| 7,296,816 | B2 | 11/2007 | Wilnau |
| 7,311,355 | B2 | 12/2007 | Fargason, III |
| 7,322,208 | B1 | 1/2008 | Griffien |
| 7,334,531 | B2 | 2/2008 | Rivera et al. |
| D564,080 | S | 3/2008 | Chen |
| 7,878,585 | B2 | 2/2011 | Salisbury |
| 8,123,290 | B1 * | 2/2012 | Aiken et al. ..... 297/180.1 |
| 2004/0075248 | A1 | 4/2004 | Elden |
| 2004/0112416 | A1 | 6/2004 | Bishirjian |
| 2004/0172752 | A1 | 9/2004 | Vo et al. |
| 2004/0177875 | A1 | 9/2004 | Brooks, III |
| 2004/0237178 | A1 | 12/2004 | Landeros |
| 2005/0082316 | A1 | 4/2005 | Betkowski et al. |
| 2005/0164627 | A1 | 7/2005 | Boone, Jr. |
| 2005/0194512 | A1 | 9/2005 | Collins |
| 2005/0263226 | A1 | 12/2005 | Smithers |
| 2005/0279391 | A1 | 12/2005 | Brooks, III |
| 2006/0032522 | A1 | 2/2006 | Brooks, III |
| 2006/0261103 | A1 | 11/2006 | Strange |
| 2006/0270535 | A1 | 11/2006 | Casey |
| 2006/0278312 | A1 | 12/2006 | Arias |
| 2007/0028358 | A1 | 2/2007 | Baek et al. |
| 2007/0096004 | A1 | 5/2007 | Quiambao, Jr. |
| 2007/0113338 | A1 | 5/2007 | Remblad |
| 2008/0018146 | A1 | 1/2008 | Wahl |
| 2008/0084104 | A1 | 4/2008 | VanHorn |
| 2008/0092285 | A1 | 4/2008 | Peterson |

OTHER PUBLICATIONS

O2 Cool Fun Fans [online] [Retrieved from the internet Dec. 4, 2008] URL—http://www.o2-cool.com/funfans_overview.php.

O2 Cool Battery Operated Fans [online] [Retrieved from the internet Dec. 4, 2008] URL—http://www.o2-cool.com/battery_overview.php.

Misty Mate/Personal Misters and Patio Misting Systems! "Cool Wave" [online] [Retrieved from the internet Dec. 4, 2008]. URL—http://www.mistymate.com/product-p/91116.htm.

BioCore Fitness Solutions—Performing at a Higher Level [online] [Retrieved from the internet Dec. 4, 2008]. URL—http://www.biocorefitness.com/how-it-works.html.

Black Ice—be cool. be very cool.—personal cooling systems [online] [Retrieved from the internet Dec. 4, 2008]. URL—http://www.blackicecooling.com/black-ice-shopping.html.

TRREX Cooling Technology keeps you cool in extreme heat/Cooling Fabric and Cold Packs [online] [Retrieved from the internet Dec. 4, 2008]. URL—http://www.trrex.com/trrex_technology.htm.

Mira Cool Cooling Products—Personnal cooling—Heat Stress Prevention Products Bandanas HeadBands Ha . . . [online] [Retrieved from the Internet Dec. 4, 2008]. URL—http://mistcooling.com/miracool.htm.

"Cool-or-Heat your Bed for a Perfect Night Sleep".

"Cool-or-Heat your bed with the new and revolutionary Cool-or-Heat Sleep Pad".

"The Coolest (or Hottest) Ride on the Road".

"Have the Coolest (or Hottest) Ride on the Road with the new Cool-or-Heat Seat Cushion".

Excerpt from Wisconsin Innovation Service Center New Product Assessment, "Breezz Angel" File # 14242, pp. 2-7.

"Kel-Gar Keep Cool Attachable Pinwheel Fan"; [online] [retrieved from the internet May 6, 2008]; http://www.walmart.com/catalog/product.do?product_id=4910778.

Bestek Electronics Co., Ltd.; "Solar Energy Fan"; [online] [retrieved from the internet May 6, 2008]; http://www.globalsources.com/gsol/l/battery-operated-fan/p/sm/1005895894.htm.

Bestek Electronics Co., Ltd.; Solar Energy Fan Manufacturer; [online] [retrieved from the internet May 6, 2008]; http://www.globalsources.com/gsol/l/Battery-operated-fan/p/bg/1005895894.htm.

Global Sources, Battery-operated fan manufacturers and suppliers; [online] [retrieved from the internet May 6, 2008]; http://www.globalsources.com/gsol/l/Battery-operated-fan-manufacturers/b/2000000003844 . . . .

Smartocean Industrial Ltd.; Water Mist Fans Manufacturer; [online] [retrieved from the internet May 6, 2008]; http://www.globalsources.com/gsol/l/Battery-operated-fan/p/sm/1005798915.htm.

Mini Hibiscus Print Fans; [online] [retrieved from the internet May 6, 2008]; http://www.orientaltrading.com/application?namespace=search&origin=searchMain.jsp&ev . . . .

Amazon.com:FS Canopy Chair: Home & Garden; [online] [retrieved from the internet May 6, 2008]; http://www.amazon.com/SHYE-WORLDWIDE-IMPORT-FS-Canopy-Chair/dp/B0013B1Y.
Koolest Products—Clamp-On Umbrella; [online] [retrieved from the internet May 6, 2008]; http://www.koolestproducts.com/p-35-clamp-on-umbrella.aspx.
Canopy Beach Chairs; BEACHMART.COM; [online] [retrieved from the internet May 6, 2008]; http://www.beachmart.com/c=CldZY58qtVO23HgAn9jiCKLHK/category/01beach_chairs . . . .
Telescope Canopy for First Class Beach Chair; BENCHMART.COM; [online] [retrieved from the internet May 6, 2008]; http://www.beachmart.com/product/BCTEL500?META=bizrate-BCTEL500&utm_source-=BIZRATE&u . . . .
Folding Lawn Chairs at Smarter.com—Shopping, Discounts and Deals; [online] [retrieved from the internet May 4, 2008]; http://www.smarter.com/---se--qq-folding+lawn+chairs--pt-0--tt-.html.
Folding Lawn Chairs at Smarter.com—Shopping, Discounts and Deals; [online] [retrieved from the internet May 6, 2008]; http:www.smarter.com/se--qq-folding%2Blawn%2Bchairs.html.
Patents: folding lawn chair with umbrella; freepatentsonline; [online] [retrieved from the Internet May 6, 2008]; http:www/freepatentsonline.com/result.html?query_txt=folding%20lawn%chair%20wit . . . .
Portable Battery Powered Fans, Air Conditioners & Cool Water Misters; [online] [retrieved from the internet Jun. 3, 2008]; http://www.safetycentral.com/batopfanspra.html.
Clip on Desk Fans; [online] [retrieved from the internet Jun. 3, 2008]; http://www.safetycentral.com/mindesflexcl.html.
Lasko Products—Clip on Fans—Model 2004; [online] [retrieved from the internet Jun. 3, 2008]; http://www.laskoproducts.com/fans/model_2004.html.
9 Oscillating personal clip fan; [online] [retrieved from the internet Jun. 3, 2008]; www.shoplet.com/office/db/g16595.html.
Electric Fans—Clip-on Fan—Epinions.com; [online] [retrieved from the internet Jun. 3, 2008]; http://www.epinions.com/Electric_Fans--reviews--clip_on.

* cited by examiner

PORTABLE COOLING DEVICE

This application is a Continuation of U.S. Non-Provisional patent application Ser. No. 12/486,331 filed on Jun. 17, 2009, which is hereby incorporated by reference in its entirety.

I. FIELD OF INVENTION

The present invention relates to portable devices for cooling individuals. In particular, the present invention relates to a flexible pads having cooling mechanisms (e.g., fans) attached thereto.

II. SUMMARY OF SELECTED EMBODIMENTS OF THE INVENTION

One embodiment of the present invention is a cooling system which includes a body section comprising a flexible material; at least two mist dispensing fans connected to the body section; and control circuitry comprising at least a first switch controlling fan speed and a second switch controlling mist dispensing.

Another embodiment is a cooler apparatus for connection to a chair device. The apparatus includes a harness section having (i) a cushion, (ii) a belt, and (iii) a pouch; a plurality of mist dispensing fans, each of the fans including a selectively releasable clamping base section; a power source, a pump and fluid reservoir operatively connected to the mist dispensing fans; and a control interface operatively connected to the fans and the pump.

A further embodiment is positioning assembly having a tool holder; an extension column; a pivot joint connecting the tool holder and extension column to allow the tool holder to pivot in a first plane; a clamp assembly comprising at least two clamping fingers hinged together and a threaded member engaging the clamping fingers to adjust a relative position of the clamping fingers; and a rotating joint connecting the clamp assembly and the extension column to allow the extension column to rotate on an axis within the first plane.

A still further embodiment is a clamp assembly including i) lower and upper clamping fingers having rear sections with hinges formed on said rear sections; ii) a pin engaging the hinges in order to rotatively connect the lower and upper clamping fingers; iii) a threaded member engaging the clamping fingers to adjust a relative position of the clamping fingers; iv) wherein the lower clamping finger comprises a pivot channel allowing rotative movement relative to the threaded member; and v) the upper clamping finger having a threaded aperture engaging the threaded member.

III. BRIEF DESCRIPTION OF THE DRAWINGS

Figure 15A:
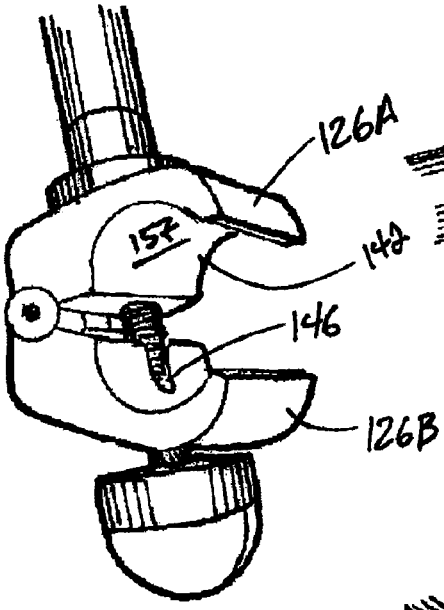
Figure 15C:
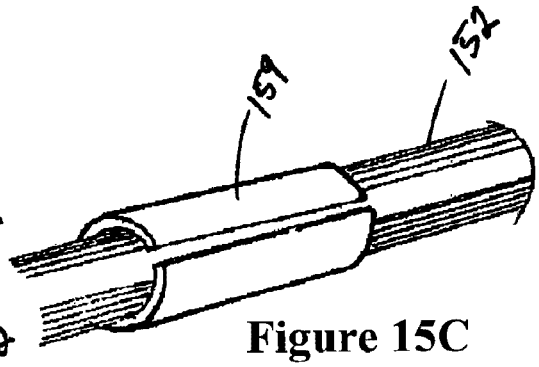
Figure 15B:
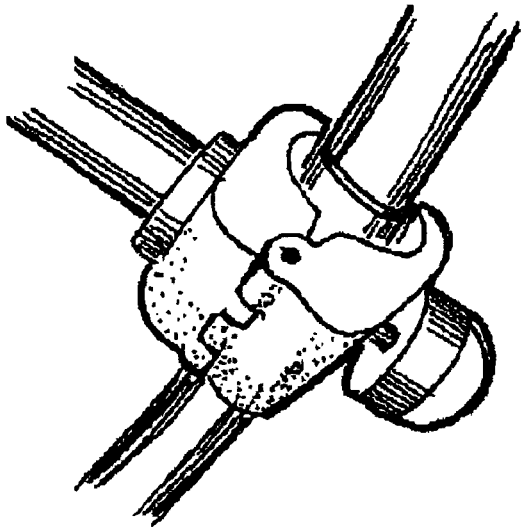

FIGS. 15A to 15C provide prospective views of the clamping assembly.

IV. DETAILED DESCRIPTION OF SELECTED EMBODIMENTS

The figures illustrate several embodiments of the present invention. However, it will be understood that reference to the figures is for the purpose of disclosing only a few embodiments of the invention and the invention is intended to encompass many variations not disclosed herein.

Figure 1:
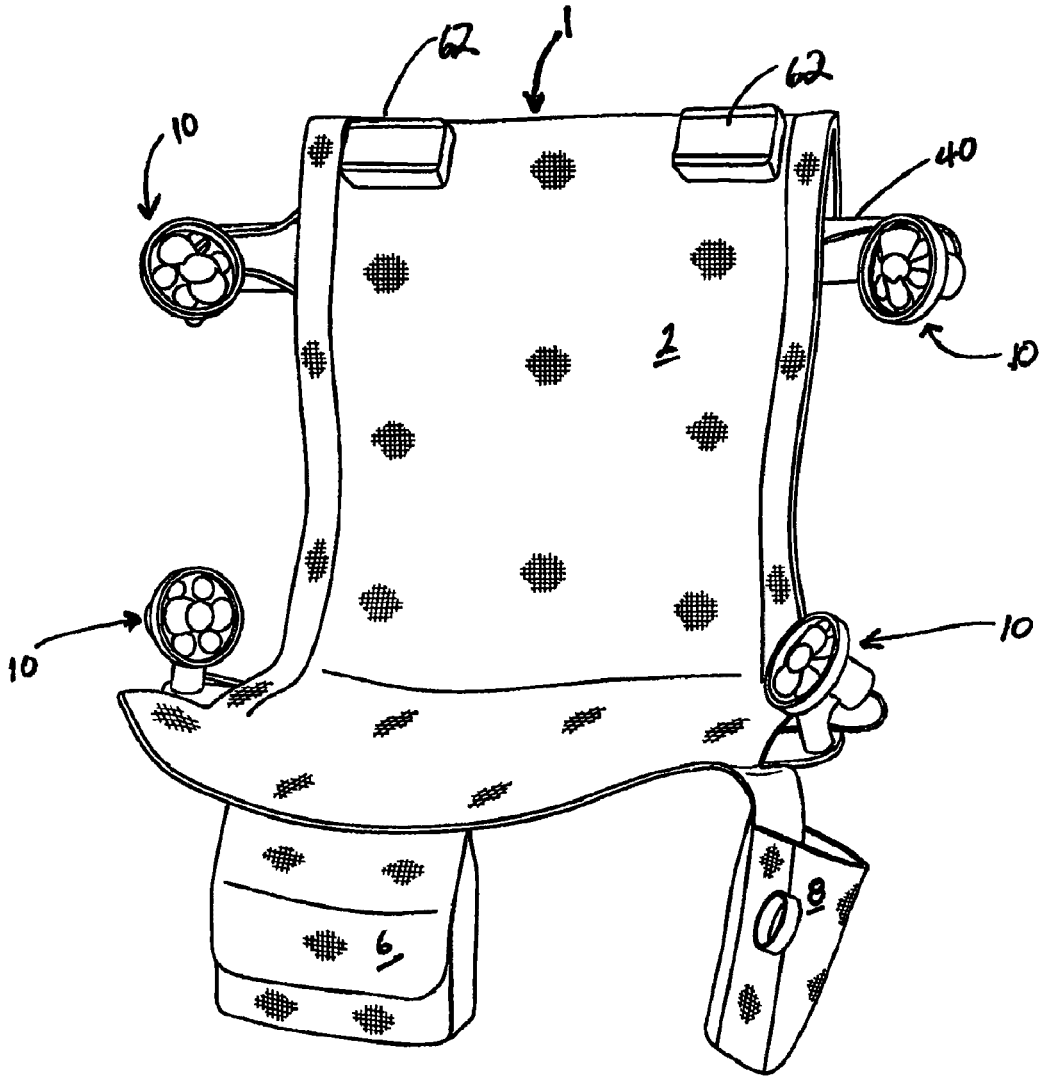
FIG. 1 is a front view of one embodiment of the cooling pad assembly.
Figure 3:
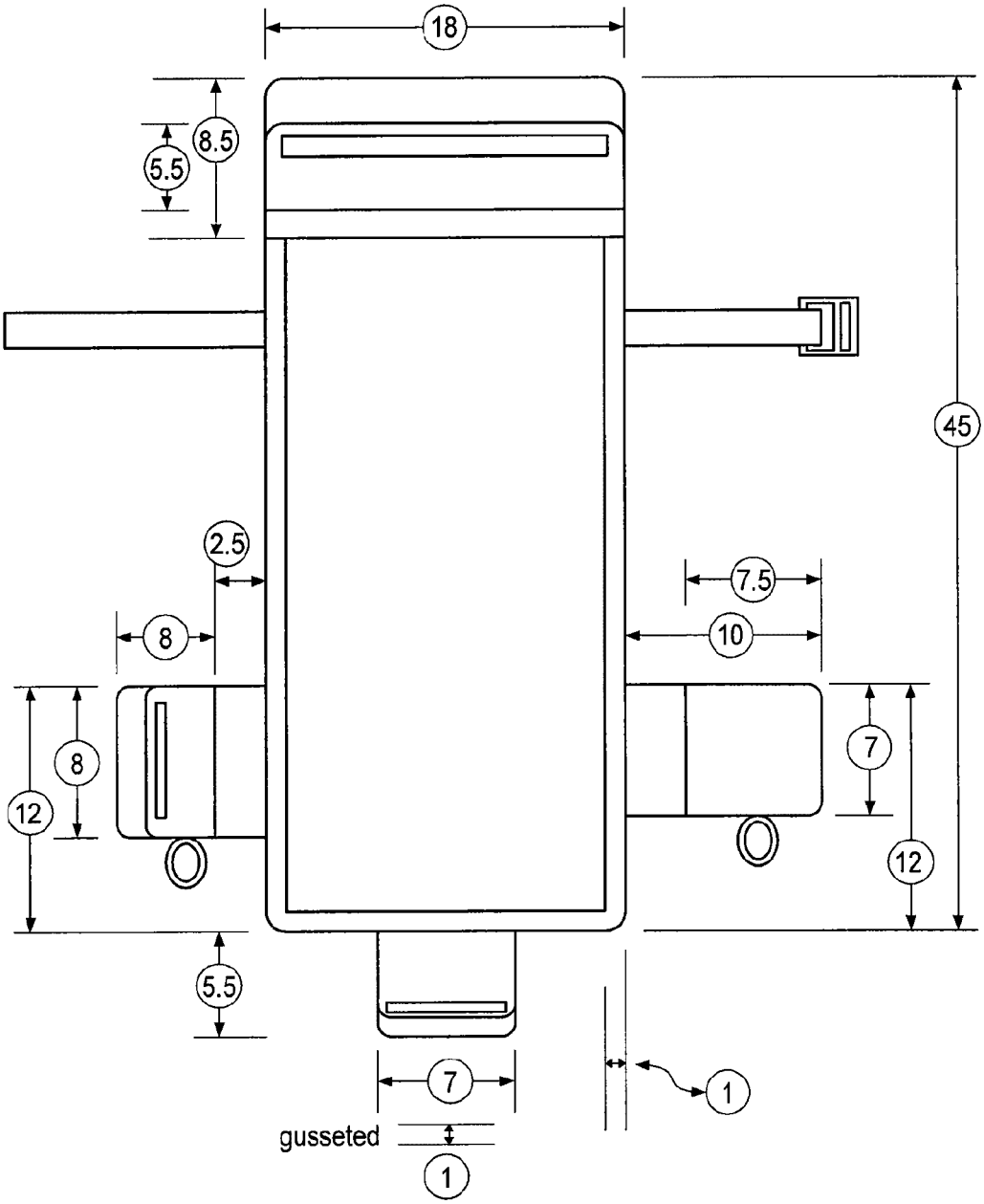
FIG. 3 is a front view of the cooling pad assembly positioned in a flat configuration.

FIG. 1 illustrates cooling pad assembly (or "cooling system") 1 which generally comprises a body section 2 constructed from a flexible material such as an acrylic. Although enumerable materials could be employed for body section 2, many embodiments will utilize a material suitable for outdoor furniture which is preferably UV and mildew/bacteria resistant; for example one of the 100% acrylic outdoor materials sold by Glen Raven, Inc. under the trademark Sunbrella®. In one preferred embodiment, the dimensions of body section 2 will be approximately 18 inches in width and 45 inches in length (and having the other dimensions in inches as shown in FIG. 3). However, other embodiments could range between about 30 inches and about 90 inches in length and between about 15 inches and about 45 inches in width. Still further embodiments of body section 2 could have lengths and widths outside of these size ranges. Additionally, many embodiments will include a padding material within body section 2 (e.g., positioned between two layers of the above acrylic Sunbrella® material which would form the outer shell of body section 2 in this embodiment). Again, enumerable padding materials could be employed, but one preferred material is compressed 100% polyester fiber.

The embodiment of body section 2 seen in the figures may also include one or more pouches or pockets attached to body section 2. FIG. 1 shows a bottom pouch 6 and a side pouch 8, while FIG. 2B shows a further top pouch 7. FIG. 1 illustrates body section 2 in the shape it would take if positioned in a chair. As best seen in FIG. 2B, the top of body section 2 is intended to hang over the back of the chair with top pouch 7 positioned on the rear side of the chair back. FIG. 2C illustrates how this example of pouch 7 may further be divided into a larger section 7A and into a smaller section 7B in order to house a fluid reservoir 36 and pump 35, respectively (both of which are explained in more detail below). FIG. 2C also shows a top flap 7C having hook & loop strips for closing pouch 7. In FIG. 2B, top flap 7C is folded over and resting against the chair back facing the viewer. FIG. 2B also illustrates a smaller pouch 64 formed on the front surface (i.e., the opposite surface seen in FIG. 2C of pouch 7). Pouch 64 may house an MP-3 player or similar music device. In a preferred embodiment, the various pouches are constructed of the same Sunbrella® material as the rest of body section 2 and sewn thereto. Of course, in alternative embodiments the pouches could be constructed of different materials and attached by methods other than sewing (e.g., hook and loop strips connecting the pouches to the body section 2). Naturally the positioning and exact number (if any) of pouches or pockets is not critical and can vary between different embodiments.

Figure 2A:
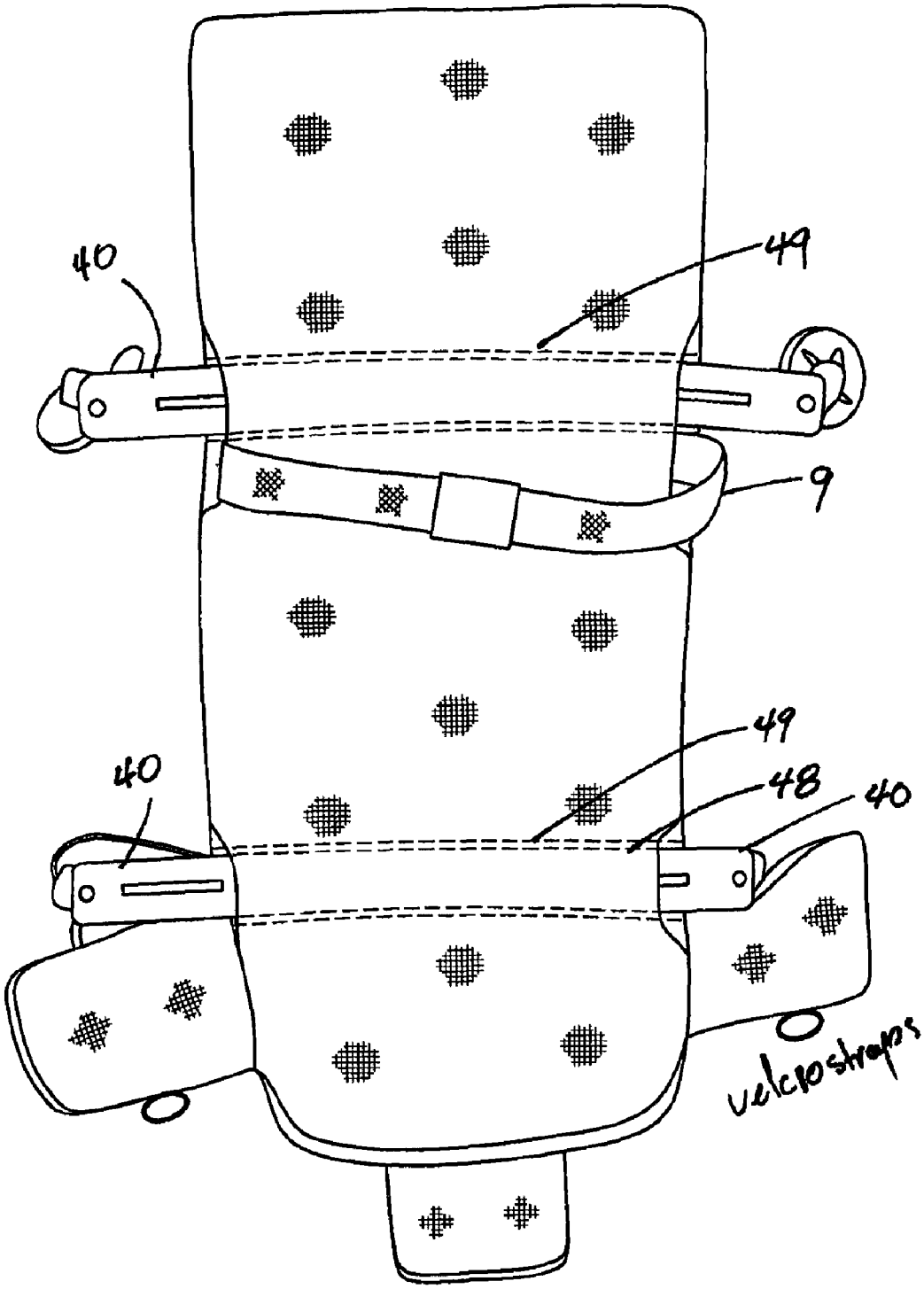
FIGS. 2A to 2C are rear views of the cooling pad assembly seen in FIG. 1.
Figure 2B:
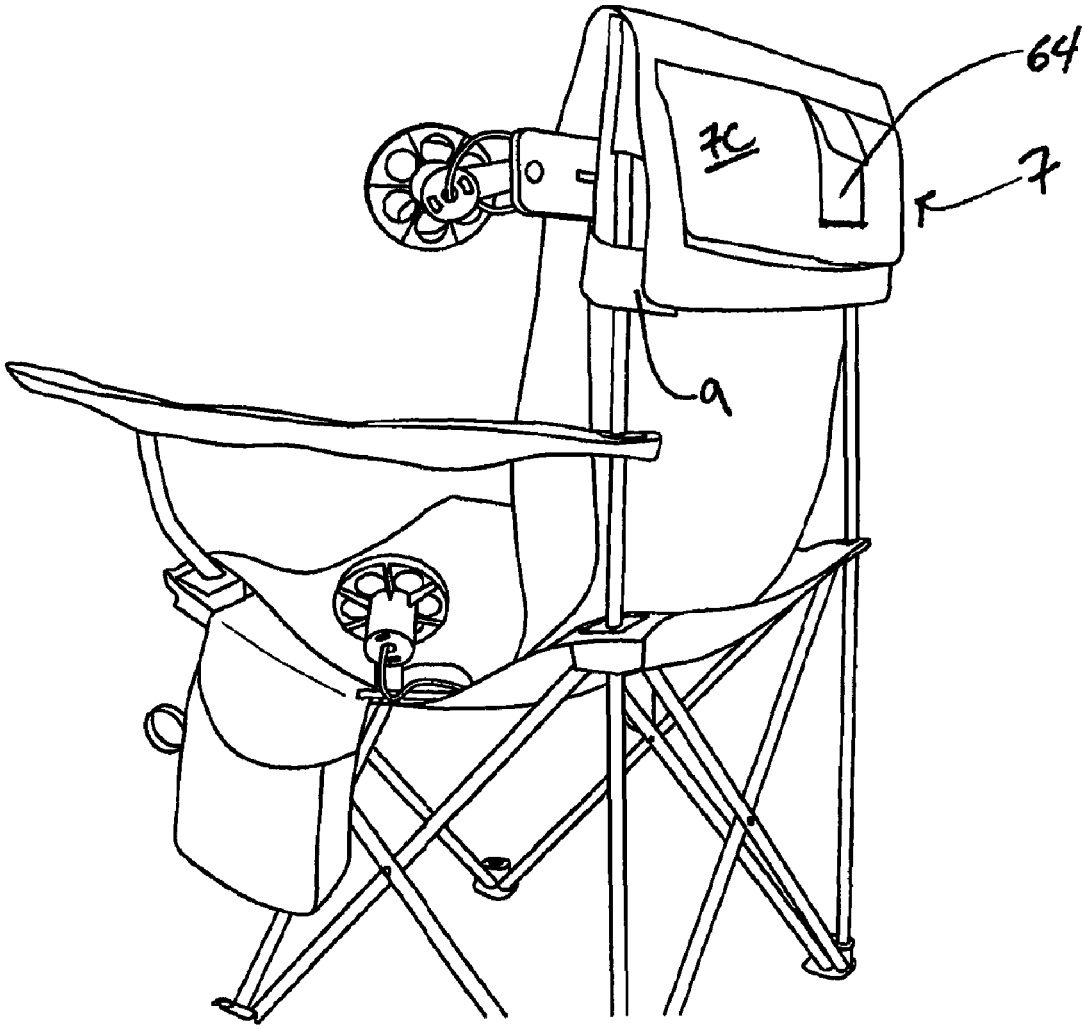
Figure 2C:
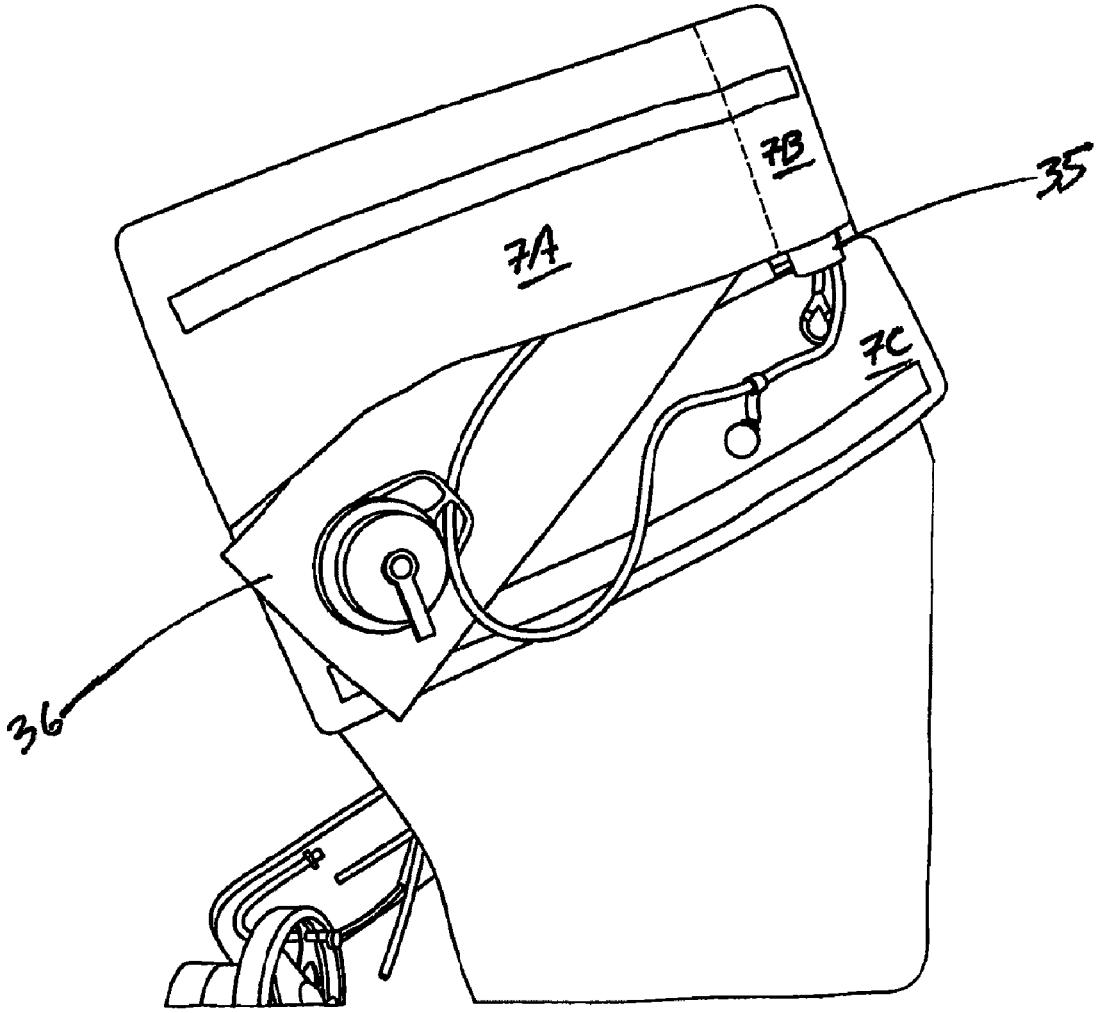

FIG. 2A also illustrates a chair back belt 9 which will wrap around the chair back and help secure body section 2 to the chair. The back belt 9 in this embodiment is formed of two straps which are sewn or otherwise attached to body section 2 at one end and have some connection mechanism on the opposite end (e.g., a buckle or hook & loop connector such as VELCRO. Rather than being sewn to the fabric of body section 2, an alternate embodiment of back belt 9 comprises a single length of material. This single length of material could be passed through a sleeve on body section 2 or if body section 2 is formed of front and back layers of material, back belt 9 could slide between these layers. Back belt 9 could also be a loop of elastic material which stretches over the chair back.

Again viewing FIG. 1, it can be seen how cooling pad assembly 1 will include at least one, preferably at least two, and most preferably four mist dispensing fans 10, although alternate embodiments could include more than four fans 10. As better seen in FIG. 2A, mist dispensing fans 10 will be mounted to fan mounting supports 40. Two horizontal sleeves 48 are formed on the rear of body section 2 by two lines of stitching 49 binding together a front and rear section of material which forms body section 2. The horizontal sleeves 48 formed between stitching lines 49 are sized to allow the fan mounting supports 40 to be inserted through the sleeves 48. In the illustrated embodiment, sleeves 48 are sized to allow mounting supports 40 to be inserted therein, but to also allow sleeves to tightly grip mounting supports 40 and prevent their casual disloging from sleeves 48.

Figures 4A, 4B, 4C:
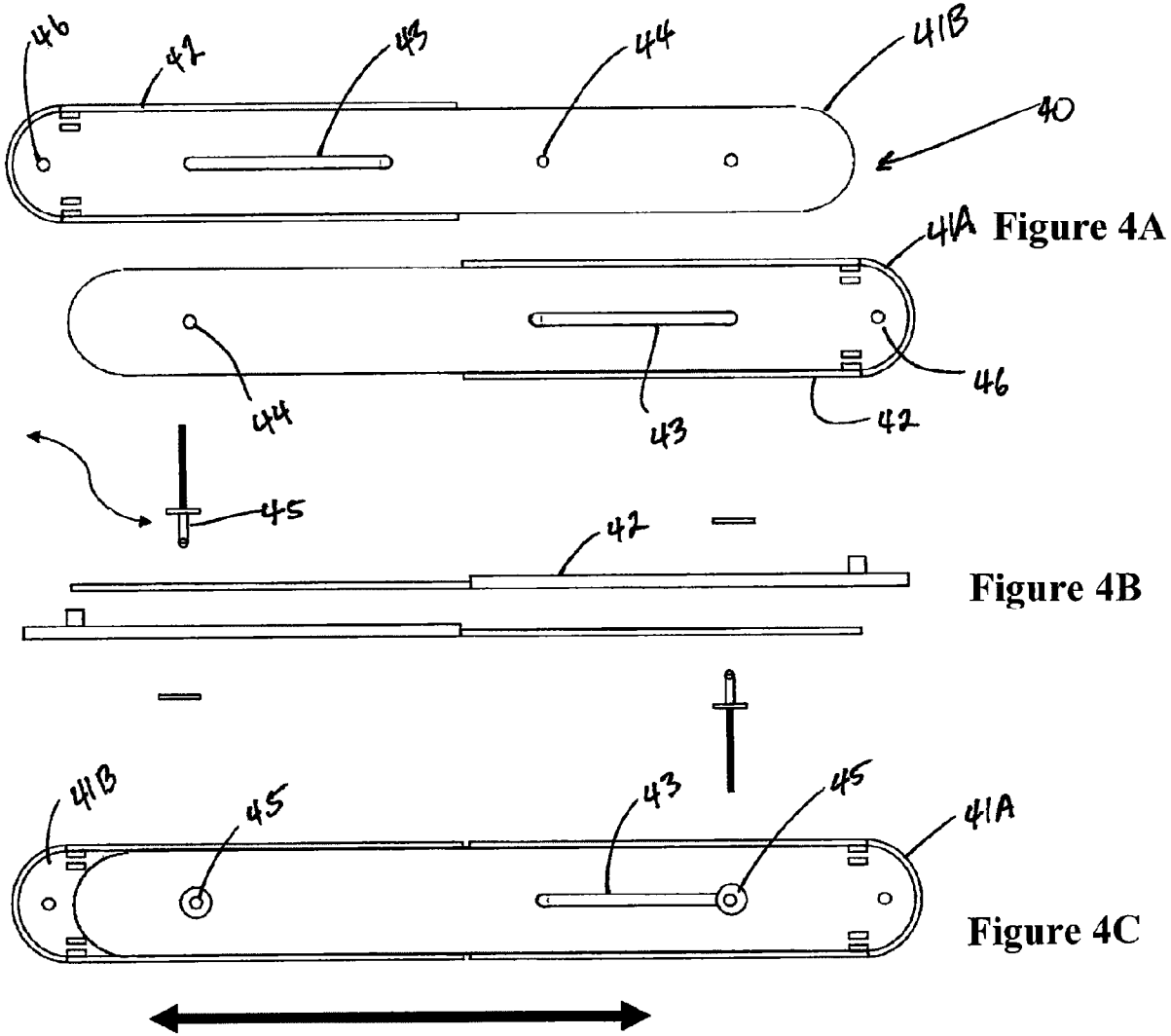
FIGS. 4A to 4C are views of one embodiment of the fan mounting support.

One embodiment of fan mounting supports 40 is seen in more detail in FIGS. 4A to 4C. FIG. 4A shows this embodiment of fan mounting supports 40 broken into its two constituent components, half-sections 41A and 41B. Each half component 41 is an elongated section having an adjustment slot 43, a pin aperture 44, fan mount apertures 46, and a support rim 42. FIG. 4B suggests how support rim 42 acts as a guide for one half-section 41 sliding on the other. FIG. 4C suggests how fixing pins 45 engage slots 43 to allow the length of mounting supports 40 to be adjusted. Fixing pins 45 will hold half-sections 41 sufficiently tightly together that half-sections 41 can slide relative to one another by applying sufficient force, but will tend to maintain their relative positions absent the application of at least a moderate force, thus making the mounting supports 40 readily adjustable in length. In the embodiment illustrated, fixing pins 45 are nylon rivets with a nylon or stainless steel complimentary washer backer. The rivets maintain the bar components with a degree of friction which allows the half-sections to slide relative to one another with application of moderate force. However, alternate embodiments could include any type of conventional or future developed connecting mechanism for holding half-sections together, either in an adjustable configuration or in a permanently fixed configuration (i.e., permanently preventing any movement between half-sections 41).

The embodiment of FIG. 2A shows two fan mounting supports 40, positioned on body section 2 such that when body section 2 is in a chair, one fan mounting support is will be near the top of the chair back and the other fan mounting support 40 will be near the bottom of the chair back. Naturally, other embodiments could use more or fewer fan mounting supports 40 positioned in alternate locations on body section 2. For example, other alternate embodiments could have a single unitary structure forming mounting supports 40. Or alternatively the mounting supports 40 need not be a structure extending across body section 2, but could also be smaller structures which are connected at the sides of body section 2. In such an embodiment, there would be four separate mounting supports (i.e., one for each fan). The mounting supports 40 could take virtually any form which will position fans 10 such that the fans can direct air flow onto a user of the cooling mat.

Figure 5A:
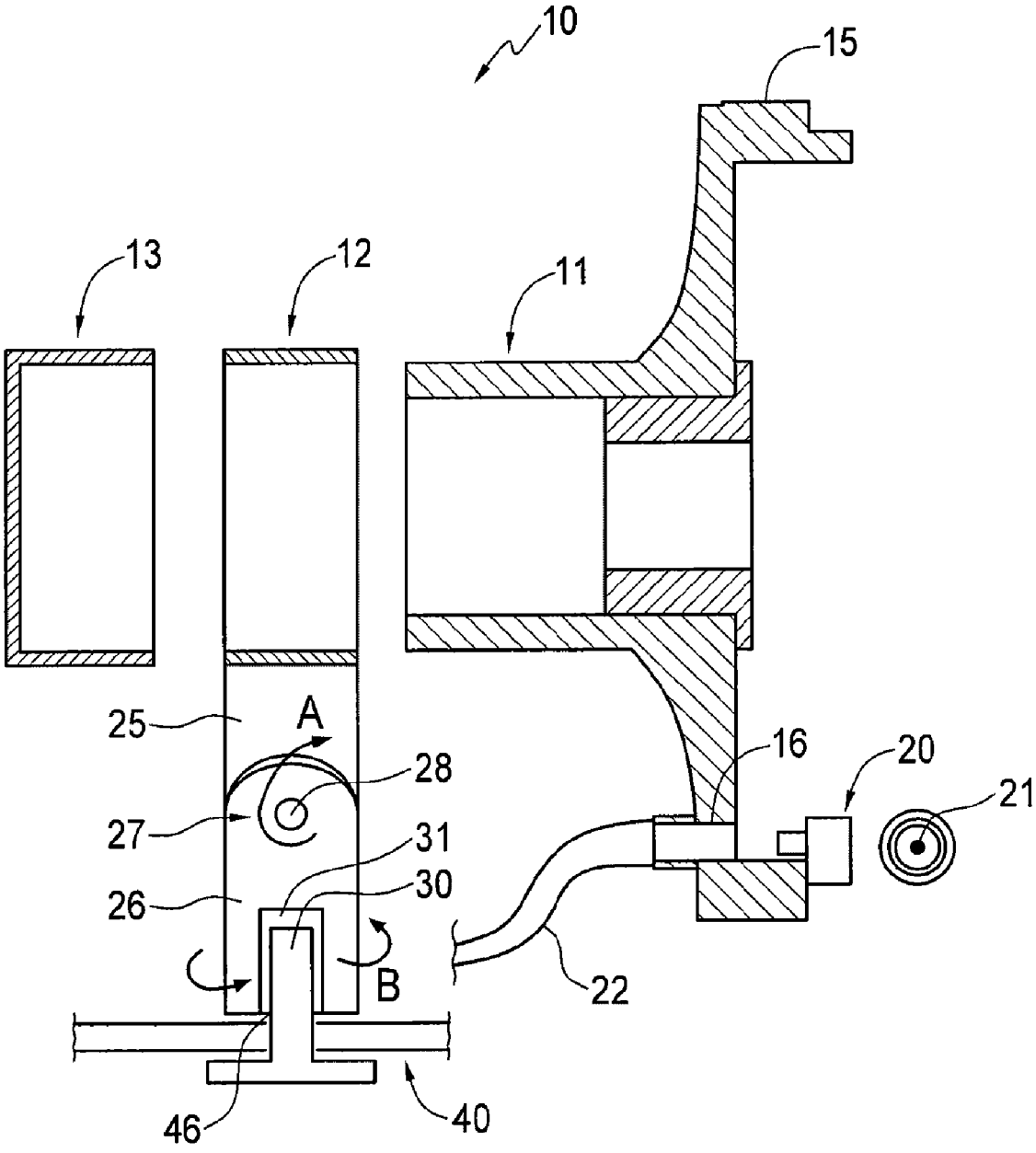
FIGS. 5A to 5C are views of one embodiment of the misting fan assemblies.
Figure 5C:
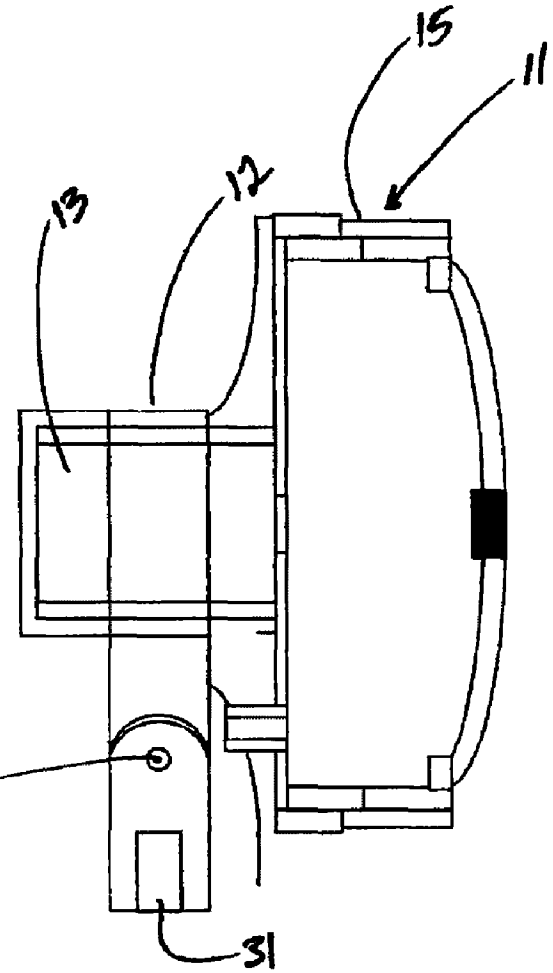
Figure 5B:
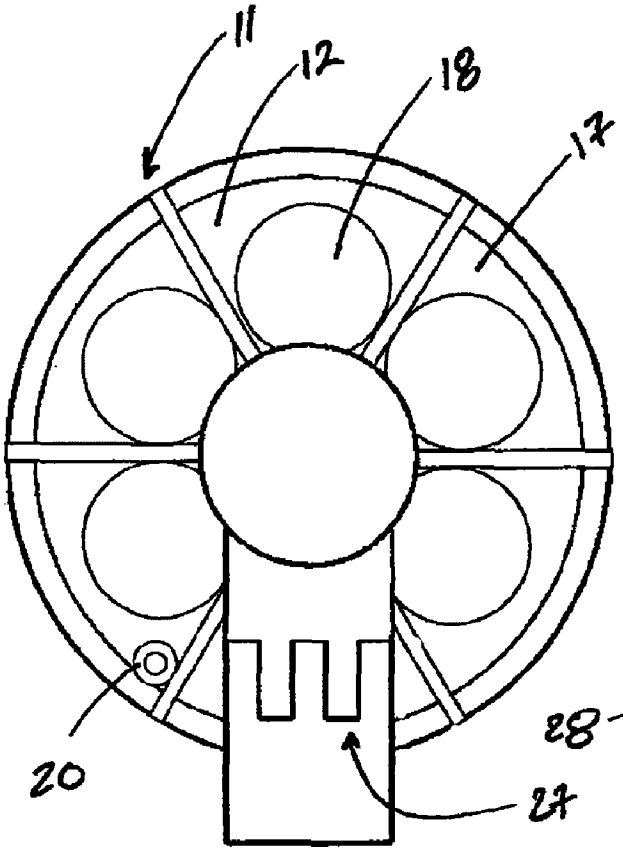

In the embodiment illustrated, mist dispensing fans 10 are attached fan mounting supports 40 via the fan mounting apertures 46 (see FIG. 4A). The illustrated embodiment of mist dispensing fans 10 is best seen in FIGS. 5A to 5C. This embodiment of mist dispensing fan 10 includes a fan housing 11, a fan bracket 12, and a fan end cap 13. Fan housing 11 will further include an interior motor space 14 and a circumferential cowling 15. Although not explicitly shown in the figures, it will be understood that a set of fan blades will be positioned within the confines of cowling 15 and attached to a motor in motor space 14. In one embodiment, fan housing 11, fan bracket 12, and a fan end cap 13 are formed of ABS or nylon by an injection molding process. The fan blade may be constructed of a soft dense foam (e.g., ethylene vinyl acetate) of a 3 mm thickness. In one embodiment, fan 10 comprises a micro-horsepower, 3 to 4 volt electric motor. The low power and soft foam fan blades of this embodiment of fan 10 prevent any harm to a user if fingers or hair come into contact with the rotating blades.

An assembled view of mist dispensing fan 10 is seen in FIG. 5C showing how the rear of fan housing 11 will pass through fan bracket 12 and be secured thereon by end cap 13. FIG. 5B illustrates how this embodiment of fan housing 11 includes a rear wall 17 having apertures 18 to allow the fan blades to draw air from the rear area of the fan. Again viewing FIG. 5A, it can be seen how fan bracket 12 includes an upper arm 25 and a lower arm 26 connected by hinge joint 27. FIGS. 5B and 5C show how this embodiment of hinge joint 27 is formed of several interlocking figures with a hinge pin 28 passing therethrough. The lower arm 26 has a retaining pin aperture 31 formed in its bottom such that retaining pin 30 (see FIG. 5A) passes through the fan mount aperture 46 (on fan mounting supports 40) and secures fan 10 thereto.

It will be understood that this manner of attaching mist dispensing fans 10 mounting supports 40 allows the fans to pivot in two rotational plans. The first rotational plane is suggested by rotation arrows "A" in FIG. 5A and consists of rotation around the hinge pin 28. The second rotational plane is suggested by rotation arrows "B" and consists of rotation around the axis of retaining pin 30. In both cases, hinge pin 28 and retaining pin 30 provide a certain degree of resistance to rotation. It is intended that a person of average strength will be able to rotate the fans to point in a desired direction, but that a moderate resistance to rotation will prevent the weight of the fan or casual jostling of the fan from changing the alignment selected by the user. FIGS. 5A to 5C illustrate only one manner of connecting mist dispensing fans 10 to mounting supports 40 and any other conventional or future developed manner of doing so is within the scope of the present invention. For example, it is not critical that the fans be able to rotate in two planes (or even one). Certain embodiments could fix the orientation of fans 10 rather than allowing any degree of adjustment.

FIG. 5A also demonstrates the "mist dispensing" aspects of fans 10 by illustrating a nozzle 20 fixed to the rim of cowling 15. A fluid (e.g., water) hose 22 extends through a hose slot 16 to engage nozzle 20. In the example of FIG. 5A, the nozzle has an exit aperture which is approximately 0.0012 inches in diameter. With the nozzle 20 in this position, the fan blades will obviously be sufficiently short not to strike nozzle 20 while rotating. Likewise, placing nozzle 20 on the inside diameter of cowling 15 is just one example placement. Nozzle 20 could be position elsewhere, such as on the outside of cowling 15 or through the shaft of the fan or even behind the fan. However, it is typically preferable to place the nozzle 20 in a manner such that the mist ejected from it is directed in air stream created by the fan. Likewise, nozzle 20 could be any device for directing water into the air path of the fan. It is not strictly necessary that the nozzle 20 form a "mist" of any particular fineness and the term "mist" is intended to encompass larger droplets and not just a fine mist. All sizes of water droplets injected in a fan's air path are intended to come within the scope of the term "mist dispensing fan."

While the figures illustrate an embodiment where all fans on body section 2 are mist dispensing, this need not be the case for all embodiments. For example, one alternative embodiment could have the two upper fans (or just one) being mist dispensing while the lower two fans do not have a nozzle and misting capabilities.

Figure 6:
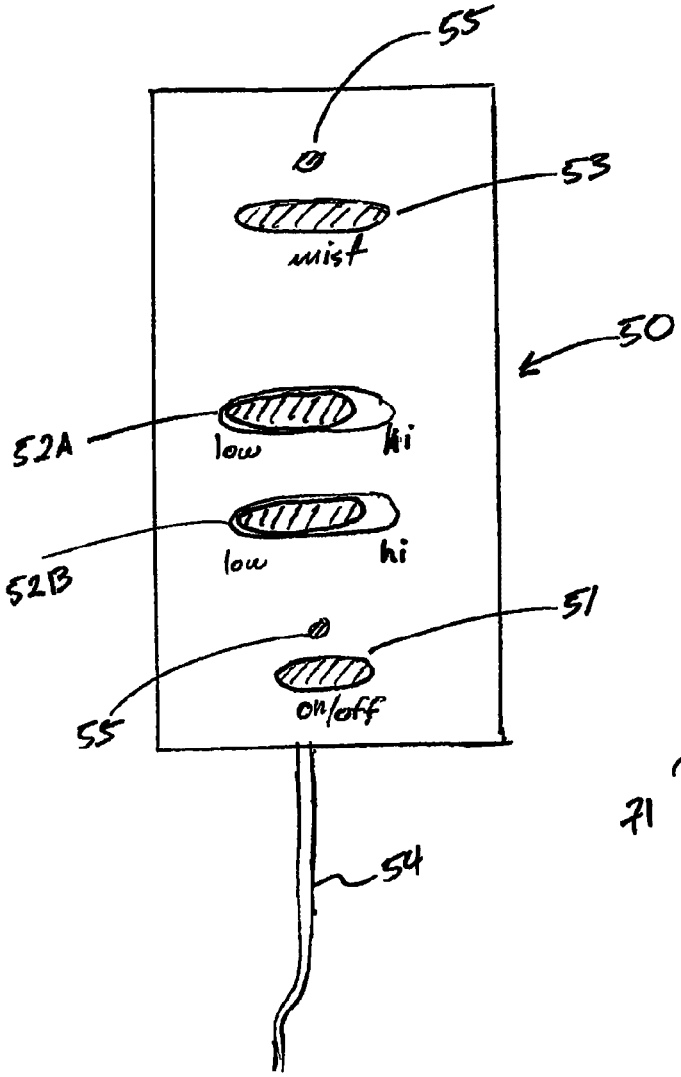
FIG. 6 illustrates one embodiment of a controller used with the cooling pad assembly.
Figure 7:
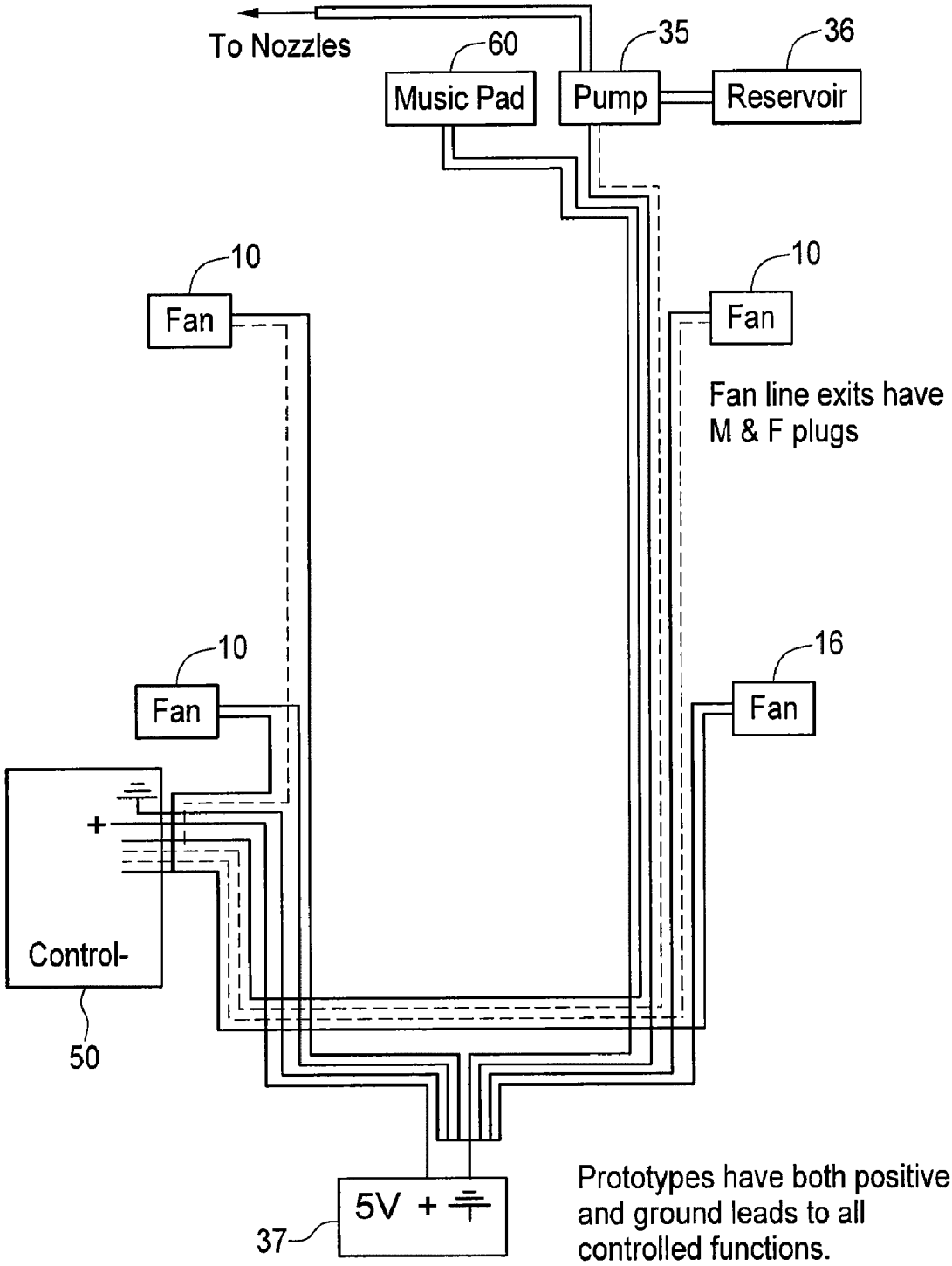
FIG. 7 is a wiring diagram for one embodiment of the cooling pad assembly.

In the illustrated embodiment, many of the functions of cooling pad assembly 1 are regulated by a controller device 50. FIG. 6 illustrates a series of switches for one example of controller device 50 and FIG. 7 illustrates a wiring diagram associated with this controller. The controller device 50 in FIG. 6 includes a power on/off toggle switch 51, sliding two position switches 52A, 52B controlling the speed of upper and lower fans 10 respectively, and an off-biased misting switch 53 which activates a misting pump when depressed. Controller device 50 may also include LEDs 55 to illustrate the on/off status of certain switches and a multi-conductor cord 54 connecting controller device 50 to the various components of cooling pad assembly 1.

FIG. 7 illustrates one possible wiring arrangement for connecting the various components to controller device 50. In addition to fans 10, FIG. 7 illustrates a battery 37, a pump 35, and a liquid reservoir 36. It will be understood that when pump 35 is activated (misting switch 53 is pressed), pump 35 will pull liquid (e.g., water) from reservoir 36 and push the water through the tubing which connects to nozzles 20 (not shown in FIG. 7). In one embodiment, the pump is a 3 to 4 volt, 50 to 100 ml/min, 5 to 12 psi miniature pump such as the model no. SP 027 RO-L sold by Schwarzer Precision AG of Essen, Germany, but many alternative pumps could be employed. Likewise, the reservoir of one embodiment is a flexible plastic pouch having a volume of approximately 30 ounces, but the reservoir could be many different container sizes, shapes, or materials. In one embodiment, the reservoir will have a large water-tight screw cap to allow easier filing. Battery (or battery pack) 37 may be any convention arrangement of one or more batteries (e.g., four "D" type batteries). Alternatively, other power supplies (e.g., 110 V, 60 Hz sources) could be employed with acceptable step-down transformers to obtain acceptable voltage levels and frequency (e.g., DC) for the components employed on cooling pad assembly 1.

Obviously, controller device 50 could take on many different configurations and the number of switches could vary depending on the number of electrical devices on the cooling pad assembly or the level of individualized device control desired. Many different components could be incorporated into the cooling pad assembly. FIG. 1 illustrates small speaker pockets 62 which hold speakers for personal music devices (e.g., an iPod 60 such as on FIG. 7). FIG. 2A illustrates a music device pocket 61 on the back of body section 2.

Figure 8:
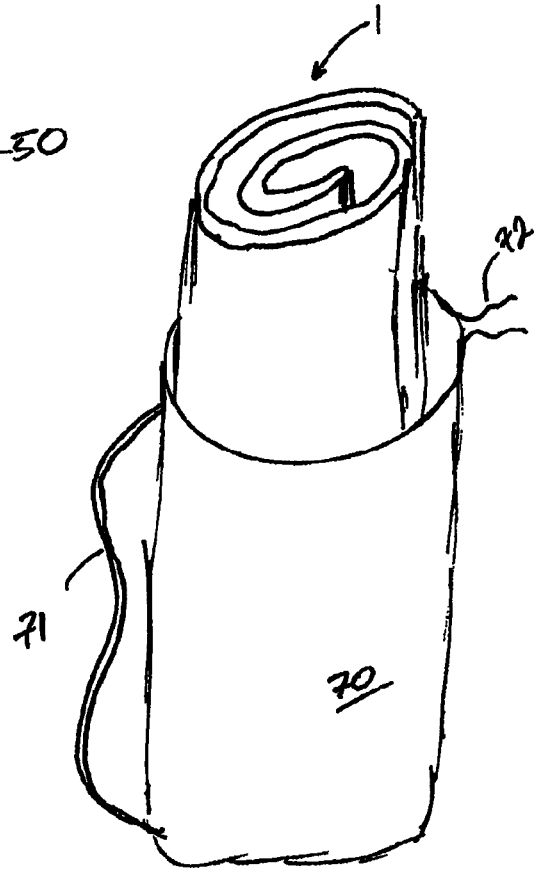
FIG. 8 illustrates the cooling pad assembly in a carrying bag.

Many additional embodiments will be apparent to those skilled in the art. FIG. 8 illustrates one example of cooling pad assembly being placed in a folded configuration and inserted into a flexible bag 70 having a carrying strap 71. Flexible bag 70 may be constructed of nylon or any suitable material. The dimensions of flexible back 70 will be sufficient to completely (or almost completely) enclose cooling pad assembly 1 when it is in a folded position. Flexible bag 70 may include draw strings 72 for closing the mouth of the bag securely around the cooling pad assembly. As used herein, placing the cooling pad assembly in a "folded" position means folding, rolling, or any other repositioning of the cooling pad assembly so that it may be inserted in bag 70 in order to be more easily transported.

Figure 9:
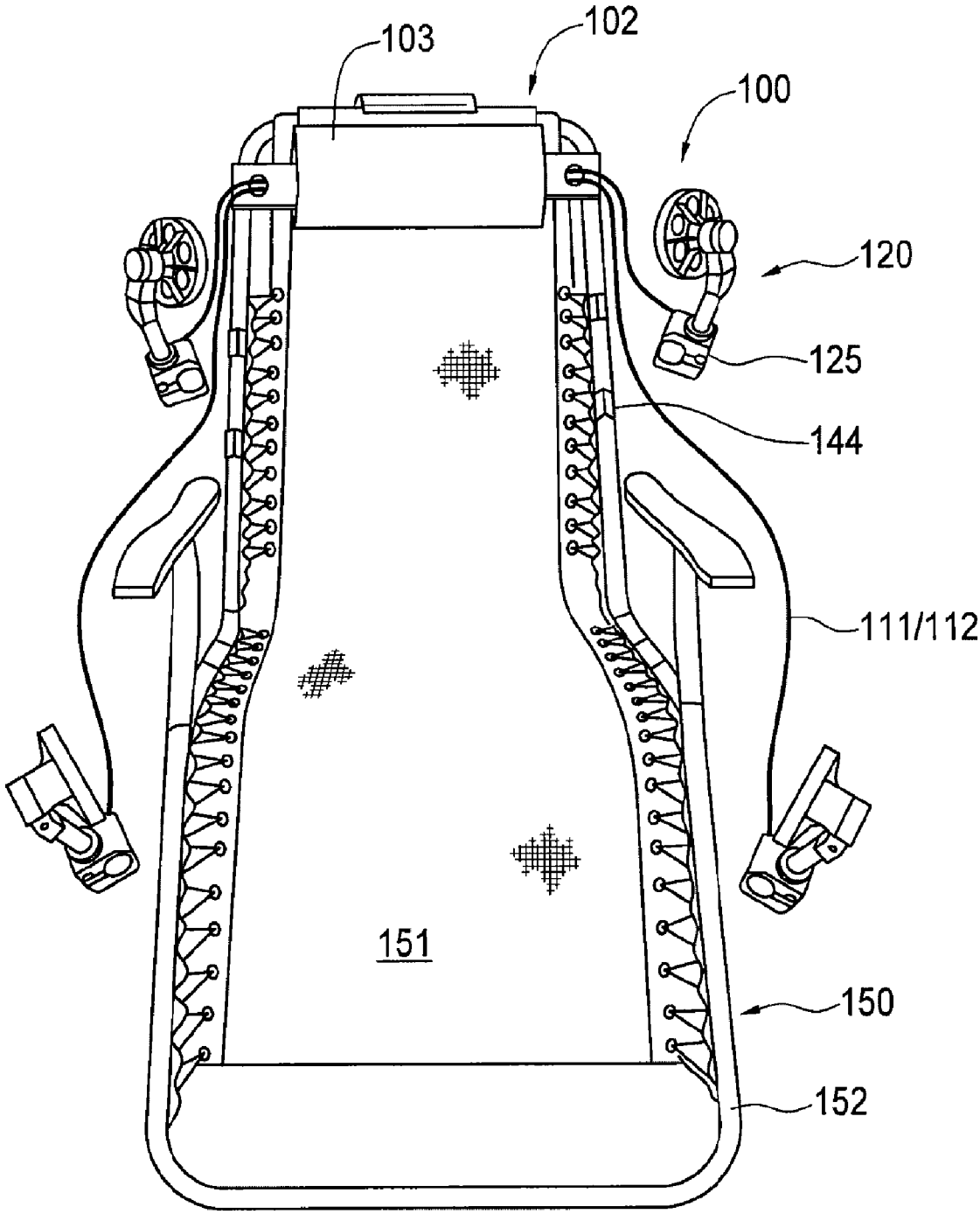
FIG. 9 illustrates another embodiment of the present invention.
Figure 10:
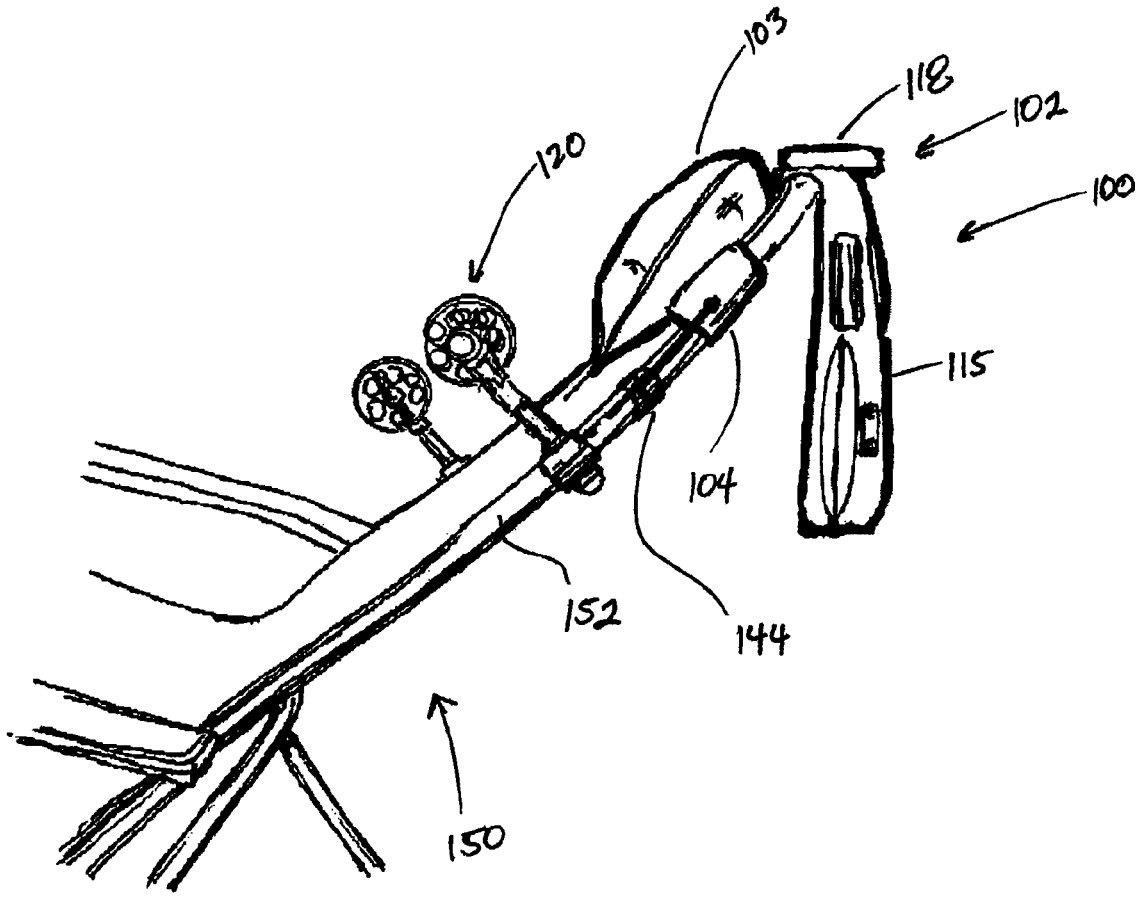
FIG. 10 is a side view of the embodiment seen in FIG. 9.
Figure 11:
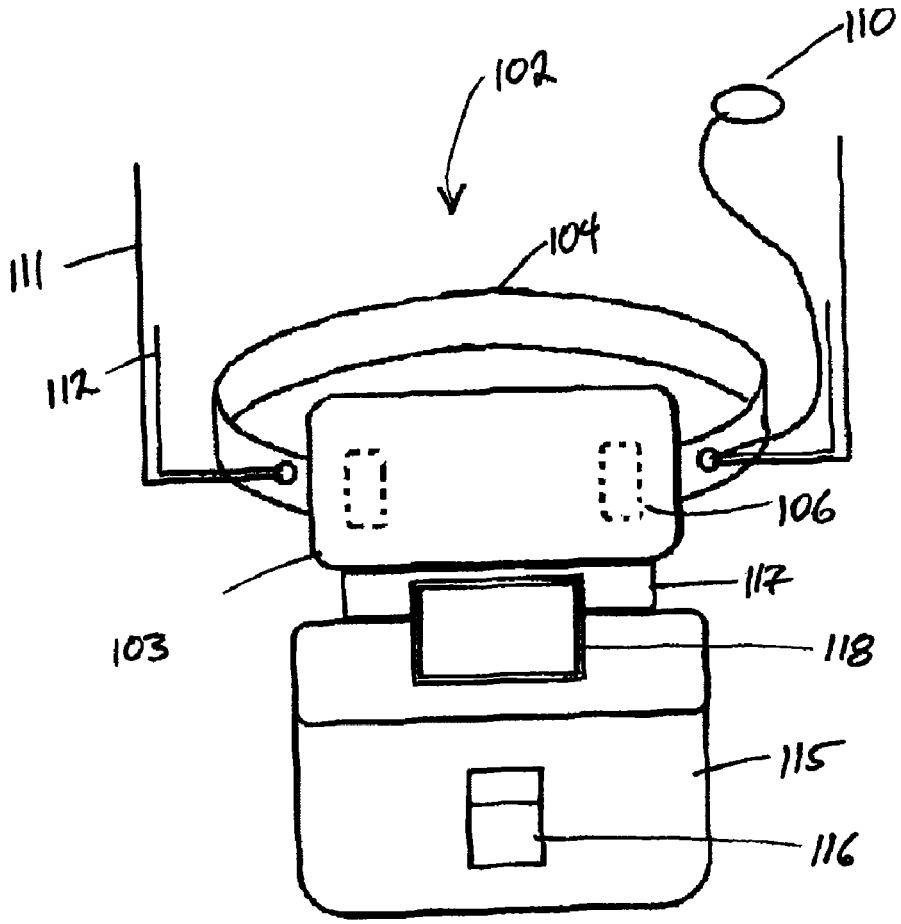
FIG. 11 illustrates a harness section in the embodiment of FIG. 9.

Another embodiment of the invention is cooling apparatus 100 illustrated in FIGS. 9 to 15. FIG. 9 shows chair device 150, which in this embodiment is a conventional lawn chair having a fabric 151 secured to a tubular frame 152. However, a "chair device" is intended to encompass any item of furniture, indoor or outdoor, made of any type of material which is intended for sitting, reclining, or otherwise resting. Cooling apparatus 100 generally comprises misting fans 120 electrically and fluidly connected to a harness section 102. One example of a harness section 102 will include a cushion 103 with a belt 104 and component pouch 115 attached thereto. Belt 104 seen in FIG. 11 is a strip of elastic material which may stretch to securely fit over and grip a back of chair device 150. Alternatively, belt 104 could have two sections joined by some type of connector (e.g., hook & loop material or a conventional buckle). This embodiment of cushion 103 is illustrated with speakers 106 mounted inside cushion 103, and in some embodiments may include an amplifier. In this embodiment, component pouch 115 is connected to cushion 103 by intermediate section 117. As in the previous embodiment, component pouch 115 can be formed of the Sunbrella® material described above. In certain embodiments, a solar panel 118 will also form part of harness section 102 and component pouch 115 will have a smaller music device pouch 116 positioned thereon. In a preferred embodiment, the solar panel 118 may be pivotally connected to cushion 103 (or alternatively intermediate section 117 or component pouch 115).

Although not explicitly shown, a (battery) power supply, water reservoir, and pump may be positioned in component pouch 115. Water lines 111 and power lines 112 will extend from the appropriate devices in component pouch 115 to the mist dispensing fans as suggested by FIG. 9. Likewise, FIG. 11 shows a controller 110 which is electrically connected to the appropriate devices within component pouch 115 (and fans 120). The arrangement of wiring and hoses may be essentially the same as seen in FIG. 7. FIG. 10 illustrates how wire clips 144 will fix wires and hoses to the frame member 152 of chair 150. In one embodiment, wire clips 144 are flexible C-shaped elements which expand in order to slide over frame member 152 and pin wires and hoses to the frame member. In the illustrated embodiment, harness section 102 includes the solar panel 118 which typically will be used to recharge/supplement a battery-based power supply. In one embodiment, solar panel 118 will be coupled to circuitry which allows charging of the batteries only when no load is being placed on the batteries (i.e., the fans and water pump are not drawing power). If solar panel 118 can generate sufficient power, alternate embodiments could possibly employ it as a complete replacement for a battery-based power source.

Figure 12:
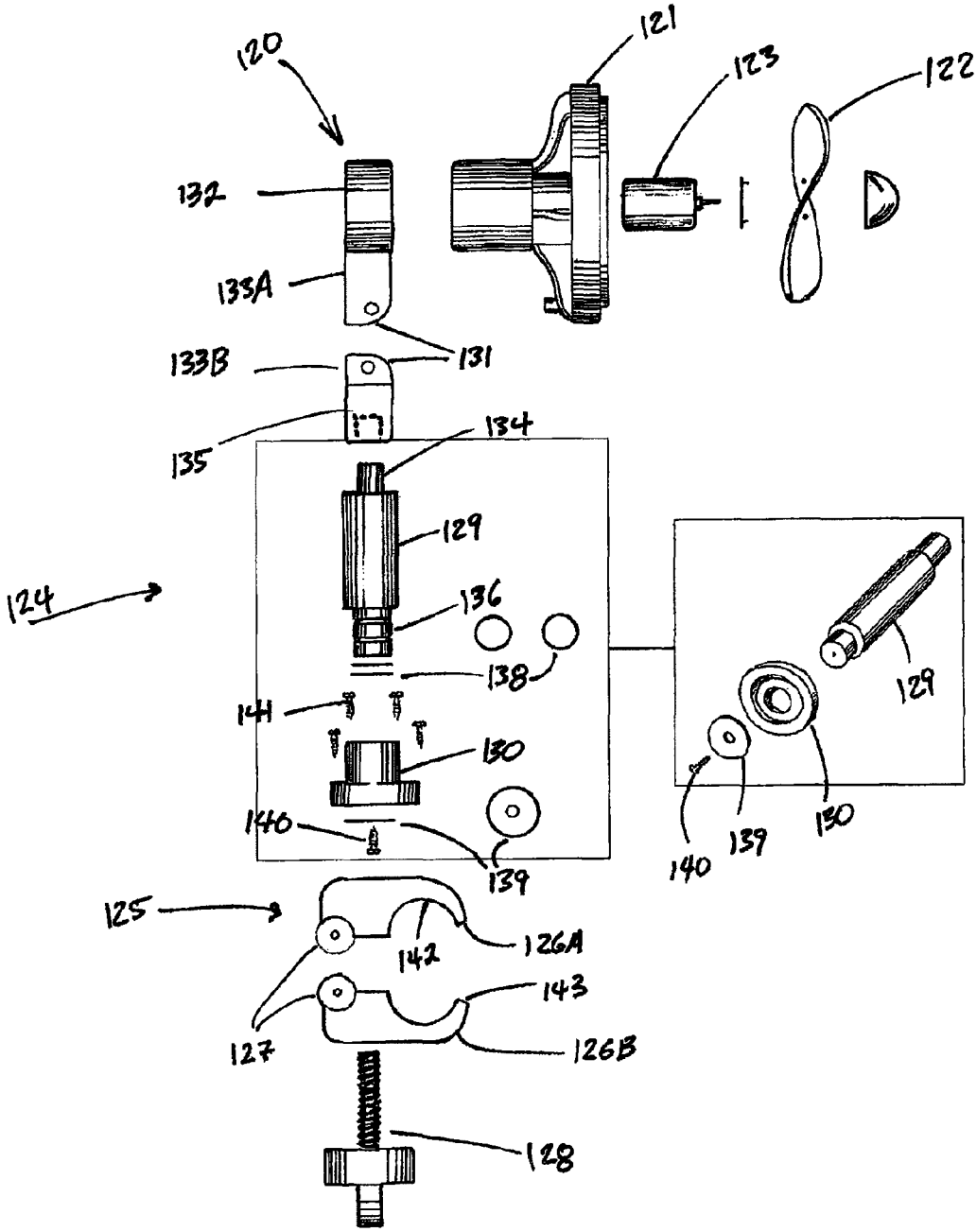
FIG. 12 illustrates a fan assembly in the embodiment of FIG. 9.
Figure 13:
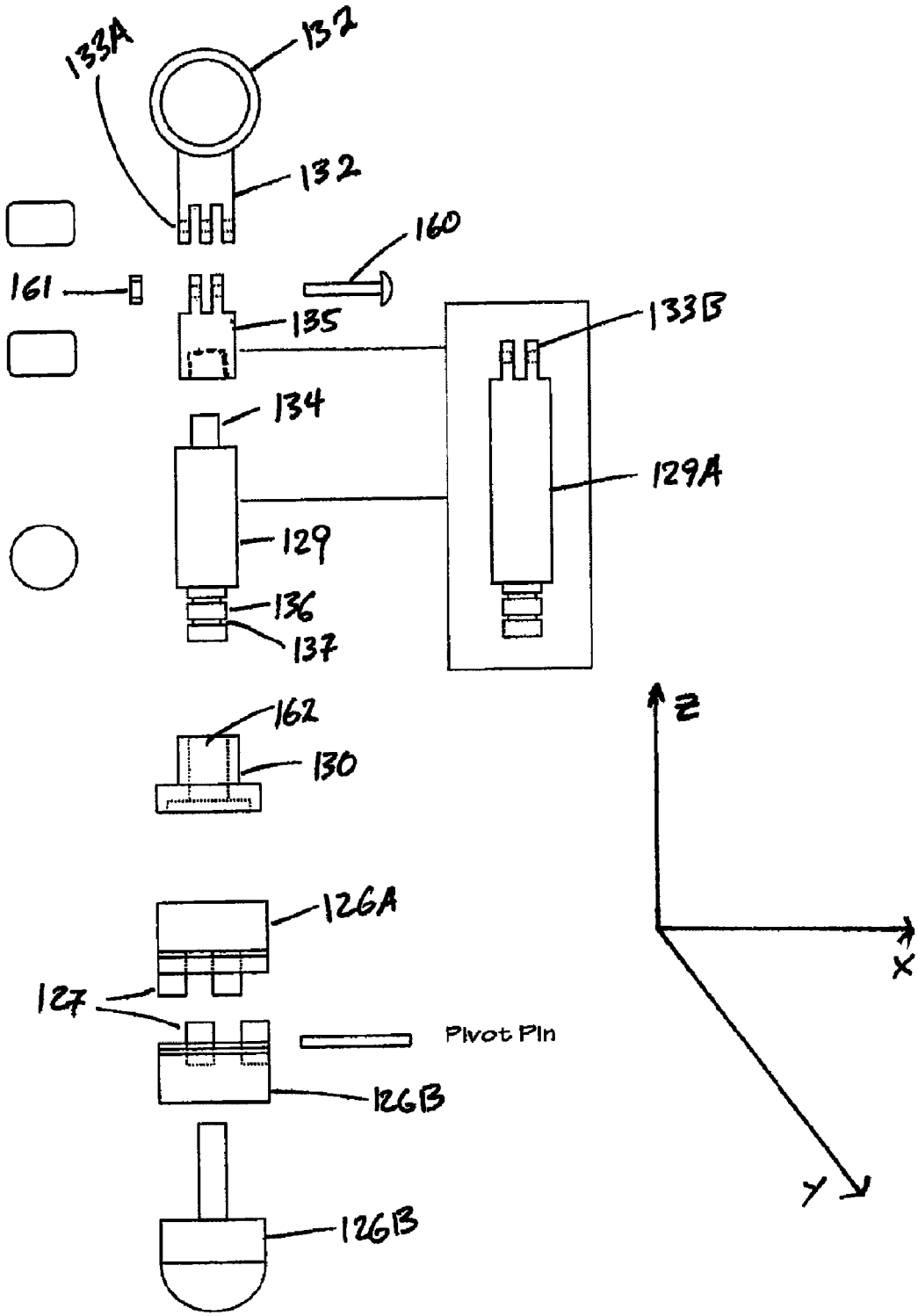
FIG. 13 illustrates the assembly in FIG. 12 rotated 90 degrees.

FIG. 12 illustrates one embodiment of the mist dispensing fans 120 which will attach to a chair device. In addition to fan housing 121, fan motor 123, and fan blades 122, fans 120 will include a clamping base section 124, one example of which includes a clamp assembly 125. In FIG. 12, clamping base section 124 connects to fan housing 121 via housing ring 132. As best seen in FIG. 13, housing ring 132 is a ring shaped member into which the rear section of fan housing 121 is inserted and fixed thereto with an adhesive (or alternatively, housing ring 132 may be sized to form a friction grip with the rear section of fan housing 121). However, the particular mechanism for gripping the fan housing is not critical and may include any conventional method or device. A connector 135 will have flange fingers 133B which are pinned between flange fingers 133A to form a pivot joint or pivot connection 131. In FIG. 13, bolt 160 engages flange fingers 133A and 133B and nut 161 retains bolt 160 in place. However, "wing nuts" or other easily hand-adjustable retaining elements may be used to loosen pressure on flange fingers 133, rotate housing ring 132 to the desired angle, and then tighten the wing nut to lock the fan in this position. Naturally, many different type of connecting hardware could be employed. In preferred embodiments, all connecting hardware such as bolt 160 and nut 161 will be formed from non-corrosive materials, non-limiting examples of which include plastic and nylon.

A fan column 129 will have an upper post 134 which connects to an aperture in connector 135. In some embodiments, upper post 134 is threaded and screws into connector 135; while in other embodiments an adhesive binds these elements; and in still further embodiments, these elements may simply be press-fitted together. Fan column 129 also has a lower post 136 with ring grooves 137 which engages the column base 130. As seen in FIG. 13, a center aperture 162 extends through column base 130 and the lower post 136 is held in this aperture by retaining washer 139 (FIG. 12) and retaining screw 140 engaging the bottom of lower post 136. However, it will be understood that this embodiment of fan column 129 may still rotate in column base 130. In a preferred embodiment, one or more O-rings 138 may engage the ring grooves in fan column 129 thereby providing a degree of frictional resistance to the rotation of fan column 129 with respect to column base 130.

Although FIG. 12 shows connector 135 formed separately from fan column 129, FIG. 13 illustrates an alternate column member 129A which provides the equivalent of connector 135 by forming a set of flange fingers 133B directly on column member 129A. Further, while the extension columns 129 and 129A are show being a fixed length, other embodiments of the extension column could have an adjustable length, for example, the column could have a telescoping structure allowing the length of the column to be adjusted and then locked at a particular length. The term "extension column" as used herein includes both columns of fixed length and columns that are adjustable in length.

Figure 14A:
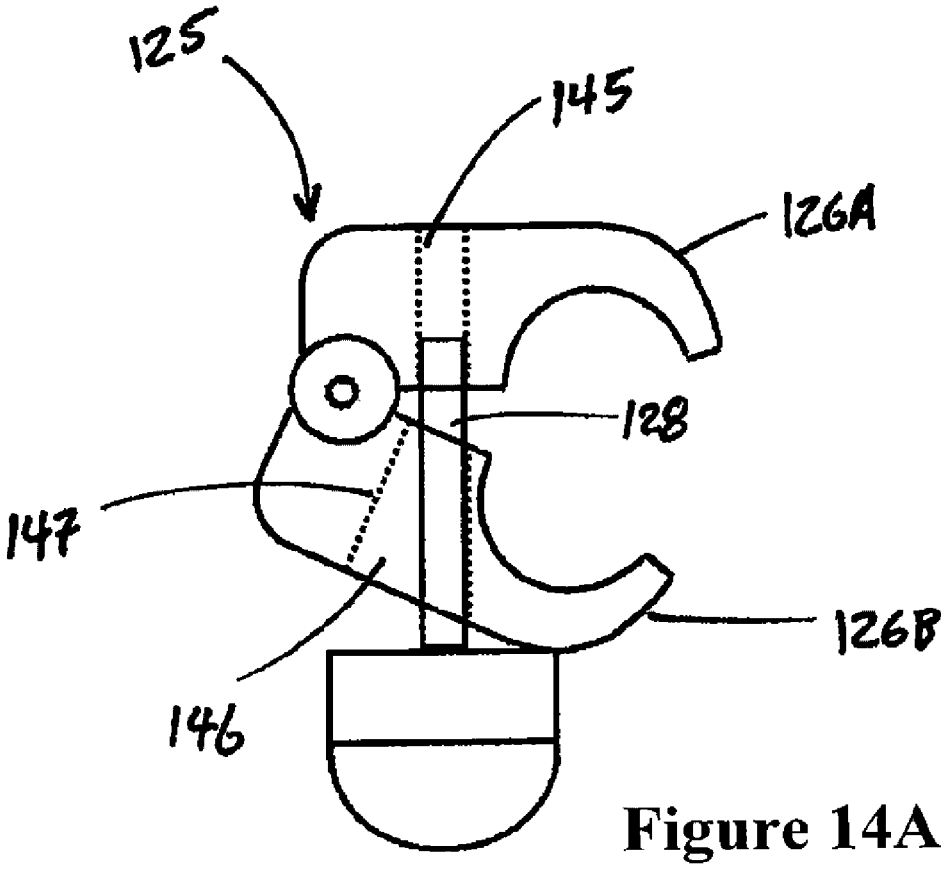
FIGS. 14A and 14B are enlarged views of one embodiment of a clamping assembly.
Figure 14B:
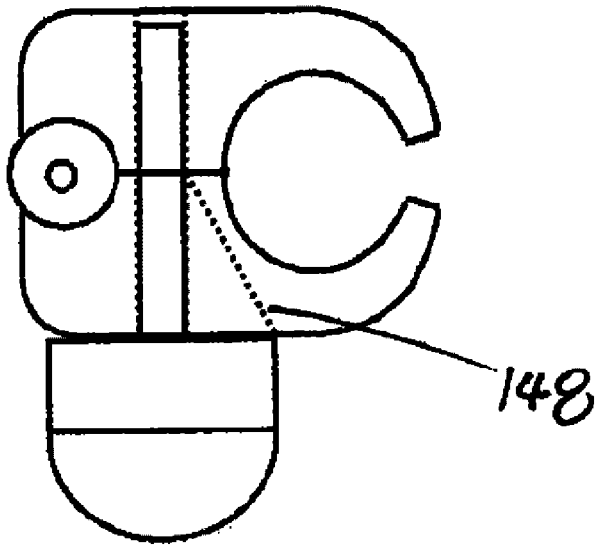

The embodiment of FIG. 12 illustrates a series of screws 141 connecting column base 130 to upper clamp finger 126A of clamp assembly 125, but naturally any other conventional or future developed manner of connecting column base 130 to clamp assembly 125 could be employed. Upper clamp finger 126A will be pinned at hinge 127 to lower clamp finger 126B. In a preferred embodiment, this hinge pin will be smooth along most of its length, but have a fluted end (or ends) which firmly grips the outer portion of the plastic hinge when pin is pressed through the hinge. As best seen in FIGS. 14A and 14B, one embodiment of clamp assembly 125 will open and close through use of a set screw 128 which threadedly engages an aperture 145 in the upper clamp finger 126A. Lower clamp finger 126B will have a pivot channel 146 as opposed to a threaded aperture. Pivot channel 146 has a vertical rear wall 147 and an inclined front wall 148 which allows lower clamp finger 126B to rotate between the open and closed positions seen in FIGS. 14A and 14B. The embodiment shown in the figures illustrates the clamping finger 126 having curved inner surfaces 142 (FIG. 15A) to grip tubular members having elliptical (including circular) cross-sections. However, inner surface 142 could form any shape cross-section (e.g., a diamond or square) to mirror the element to which it is clamping.

The embodiment of clamp fingers 126 seen in FIG. 12 have curved surfaces 142 to grip a tubular frame of a chair device. To prevent slipping in one particular embodiment shown in FIG. 15C, a flexible translucent sleeve 159 (formed from, for example, silicone or urethane) is positioned on the tubular frame 152 at the spot where clamping assembly 125 engages the frame. In alternative embodiments such as suggested in FIG. 15A, the inner surface of clamp fingers could include a high friction surface 157. In one embodiment, this high friction surface is formed by an irregular surface pattern (e.g., a dimple pattern, a checkered pattern, or a knurled tooth pattern) form on the corresponding surface of the clamp finger mold. Alternatively, a hard grit-like material (e.g., metal carbides) could be fixed on the clamping finger with an adhesive. In a still further embodiment, the high friction surface 157 may be formed by applying a material (e.g., silicone or urethane) which is relatively soft compared to the harder material (e.g., ABS or nylon) forming the clamping fingers 126. Modern injection molding techniques allow different materials to be injected into different areas of the mold. For example, a hard plastic is injected into the mold to form the main body of clamping fingers 126, but a thin layer of silicone or urethane is also injected to form the high friction surface 157.

Nor is clamping assembly 125 limited to gripping tubular members. The front edges 143 of the gripping fingers 126 are be sufficiently wide to enable the gripping fingers to also fasten securely to a flat surface or some irregular surface. Although the clamping base section 124 has been described as using of one specific example clamping assembly 125, the clamping base section could employ any number of other clamping mechanisms.

As suggested by FIGS. 9 and 10, cooling apparatus 100 may be positioned on any conventional or future developed chair device. Belt section 104 is positioned over the back of the chair and either tightened by a connection device or simply grips the chair because the belt is formed of an elastic material which has been stretched over the chair back. As best seen in FIG. 10, a cushion 103 is connected to component pouch 115 which hangs over the back and to the rear of the chair. Preferably solar panel 118 will be positioned on the top of the chair back (generally parallel to the ground surface) in order to maximize its exposure to solar radiation. The mist dispensing fans 120 will be positioned on the chair at locations selected by the user. The user may then employ controller 110 to operate the cooling device in the same manner as described above with respect to FIGS. 6 and 7.

Although the positioning mechanism shown in FIGS. 12-14 has been adapted to selectively position a fan, the same type of positioning mechanism could be used to selectively position any number of different items or "tools." Nonlimiting examples of tools other than fans could include theatrical equipment (lights, cameras, speakers, microphones, etc.), medical equipment (hoses, scopes, etc.), and virtually any instance where an item needs to be clamped to a tubular member and positioned at a given orientation. For example, scaled-up versions of the positioning mechanism could be used to suspend road signs. In this more generalized embodiment, the fan housing ring is a more generic a tool holder 132 and could take the form of a second clamp assembly 125, any other type of clamp assembly, a cup holder, a water bottle holder, or any other device for gripping any number of tools. The extension column 129 could take on any form describe above or another column-type design. The pivot joint 131 connecting the tool holder (e.g., fan housing ring 132) to the extension column allows the tool holder to pivot in one plane (i.e., rotate in the z-y plane suggested by the x-y-z coordinate system shown on FIG. 13). This embodiment would include a clamp assembly having at least two clamping fingers hinged together and a threaded member engaging the clamping fingers to adjust a relative position of the clamping fingers. The lower post 130 engaging column base forms one example of a rotating joint connecting the clamp assembly and the extension column and allows the extension column to rotate around an axis within the first plane (e.g., in FIG. 13, the tool holder 132 rotates in the z-y plane while extension column 129 rotates around the z-axis).

Another embodiment is a cooling system which includes a body section comprising a flexible material; at least two mist dispensing fans connected to the body section; and control circuitry comprising at least a first switch controlling fan speed and a second switch controlling mist dispensing. This embodiment could have numerous variations such as: i) the flexible material is sufficiently flexible to allow the body section to be rolled into a coiled configuration; ii) an adjustable fan mounting support being connected to the body section; iii) the fan mounting support comprising two overlapping sections and a position lock adjustably fixing the relative position of the overlapping sections; iv) the body section comprises a sleeve through which the fan mounting support extends; v) the body section comprises a back side and a flexible strap attached to the back side allowing the body section to be secured to a chair; the mist dispensing fans are attached to the mounting support by a pivotal connector, the pivotal connector allowing the fans to pivot in at least two planes; vi) mist dispensing fans comprise a fan housing which includes a fan motor, fan blades, and a nozzle connected to a water reservoir; vii) the fan housing comprises a circumferential structure around the blades and the nozzle is attached to the circumferential structure; viii) the body section is between about 30 inches and about 90 inches in length and is between about 15 inches and about 45 inches in width; ix) the pouches are positioned at approximately first and second ends of the body section; x) a water reservoir is positioned on the body section and connected via tubing to the mist dispensing fans; xi) a battery pack is positioned in one of the pouches; xii) a water pump is positioned along the tubing between the reservoir and the nozzle; xiii) the fan housing comprises a rigid foam material; xiv) the first switch is a sliding switch with a high speed and a low speed position; xv) the second switch is an off-biased push button switch; or xvi) the control circuitry further comprises a power on/off switch controlling electrical power to the water pump and mist dispensing fans.

A further embodiment is positioning assembly having a tool holder; an extension column; a pivot joint connecting the tool holder and extension column to allow the tool holder to pivot in a first plane; a clamp assembly comprising at least two clamping fingers hinged together and a threaded member engaging the clamping fingers to adjust a relative position of the clamping fingers; and a rotating joint connecting the clamp assembly and the extension column to allow the extension column to rotate on an axis within the first plane. This embodiment could have numerous variations such as: (i) the rotating joint comprises a column base having a aperture formed there through, (ii) the extension column comprises a lower post which engages the aperture and includes at least one ring groove, and (iii) an O-ring is positioned in the ring groove. Still further variations of this embodiment include the clamp assembly comprising: (iv) a lower clamping finger having a pivot channel allowing rotative movement relative to the threaded member; and (v) an upper clamping finger having a threaded aperture engaging the threaded member.

A still further embodiment is a clamp assembly including i) lower and upper clamping fingers having rear sections with hinges formed on the rear sections; ii) a pin engaging the hinges in order to rotatively connect the lower and upper clamping fingers; iii) a threaded member engaging the clamping fingers to adjust a relative position of the clamping fingers; iv) wherein the lower clamping finger comprises a pivot channel allowing rotative movement relative to the threaded member; and v) the upper clamping finger having a threaded aperture engaging the threaded member. This embodiment could have numerous variations such as: vi) the threaded ember having a hand-grip allowing for hand-tightening thereof; vii) the upper and lower clamping fingers have an inner surface forming an elliptical shape; viii) the upper and lower clamping fingers comprise a material of a first hardness and the inner surface comprises a material of a second hardness less than the first hardness; or ix) the upper and lower clamping fingers have an inner surface with a high-friction surface formed thereon.

Although the above specification describes certain example embodiments, the invention should not be considered limited to such embodiments and all obvious improvements and modifications of the disclosed embodiments are intended to come within the scope of the following claims.

We claim:

1. A cooling system comprising:

a. a body section consisting substantially of a material sufficiently flexible to allow said body section to be rolled into a coiled configuration;

b. a fan mounting support positioned on said body section;

c. at least two mist dispensing fans pivotally connected to said mounting support, said fans including a fan housing including a circumferential structure around said blades and a nozzle attached to said circumferential structure;

d. a water reservoir and pump positioned on said body section and supplying pressurized water to said nozzle;

e. a power source positioned on said body section; and f. a controller including circuitry allowing control of fan speed and activation of said water pump.

2. The cooling system according to claim 1, wherein said body section comprises a sleeve through which said fan mounting support extends.

3. The cooling system according to claim 1, wherein said mist dispensing fans are attached to said mounting support by a pivotal connector, said pivotal connector allowing said fans to pivot in at least two planes.

4. The cooling system according to claim 1, wherein said body section is between about 30 inches and about 60 inches in length and is between about 15 inches and about 30 inches in width.

5. The cooling system according to claim 1, further comprising pouches positioned at approximately first and second ends of said body section.

6. The cooling system according to claim 5, wherein a water reservoir is positioned in one of said pouches and connects via tubing to said mist dispensing fans.

7. The cooling system according to claim 6, wherein a water pump is positioned along said tubing between said reservoir and said nozzle.

8. The cooling system according to claim 1, wherein said controller comprises an off-biased push button switch operating said pump.

9. The cooling system according to claim 1, wherein said controller further comprises a power on/off switch controlling electrical power to said water pump and mist dispensing fans.

10. A cooler apparatus for connection to a chair device, said apparatus comprising:

a. a harness section;

b. at least one mist dispensing fan, said at least one fan including a selectively releasable clamping base section;

c. a power source, a pump and fluid reservoir operatively connected to said at least one mist dispensing fan; and d. a control interface operatively connected to said fan and said pump.

11. The cooler apparatus according to claim 10, further comprising a chair device wherein said belt engages a chair back and said fan clamping base sections engage a frame member of said chair device.

12. The cooler apparatus according to claim 10, wherein said mist dispensing fans comprise a fan housing which includes a fan motor, fan blades, and a nozzle connected to a water reservoir.

13. The cooler apparatus according to claim 12, wherein said fan housing comprises a circumferential structure around said blades and said nozzle is attached to said circumferential structure.

14. The cooler apparatus according to claim 10, wherein said clamping base section further comprises a clamp assembly including at least two clamping fingers hinged together and a threaded member engaging said clamping fingers to adjust a relative position of said clamping fingers.

15. The cooler apparatus according to claim 10, further comprising a water reservoir positioned on said body section and connected via tubing to said mist dispensing fans.

16. The cooler apparatus according to claim 15, wherein a battery pack is positioned in said pouch.

17. The cooler apparatus according to claim 15, wherein a water pump is positioned along said tubing between said reservoir and said nozzle.

18. The cooler apparatus according to claim 10, wherein said control interface further comprises a power on/off switch controlling electrical power to said water pump and mist dispensing fans.

19. The cooling system according to claim 1, further comprising:

g. wherein said body section is placed in a folded configuration and positioned in a separate carrying bag.

* * * * *